US005692375A

United States Patent [19]

Novak et al.

[11] Patent Number: 5,692,375

[45] Date of Patent: Dec. 2, 1997

[54] BIFURCATED EXHAUST MANIFOLD FOR A V-TYPE ENGINE

[75] Inventors: James Michael Novak, Dearborn Heights; Christopher A. Trentadue, Saline, both of Mich.

[73] Assignee: Ford Global Technologies, Inc., Dearborn, Mich.

[21] Appl. No.: 763,642

[22] Filed: Dec. 11, 1996

[51] Int. Cl.[6] ..... F01N 7/10

[52] U.S. Cl. ..... 60/323

[58] Field of Search ..... 60/323; 123/54.7

[56] References Cited

U.S. PATENT DOCUMENTS

| | | | |
|---|---|---|---|
| 3,768,248 | 10/1973 | Grgurich et al. | 60/323 |
| 4,056,933 | 11/1977 | Nohira et al. | 60/278 |
| 4,514,986 | 5/1985 | Benson | 60/605 |
| 4,731,995 | 3/1988 | McFarland, Jr. | 60/313 |
| 5,134,851 | 8/1992 | Davis | 60/313 |

FOREIGN PATENT DOCUMENTS

| | | | |
|---|---|---|---|
| 842873 | 5/1952 | Germany | 60/323 |
| 171817 | 8/1986 | Japan . | |
| 527059 | 10/1940 | United Kingdom | 60/323 |

*Primary Examiner*—Tony M. Argenbright
*Attorney, Agent, or Firm*—Donald A. Wilkinson

[57] ABSTRACT

A four stroke internal combustion engine (10) having a V-type configuration with eight cylinders (11). The firing order of the cylinders is such that a relatively balanced mechanical operation occurs. A right manifold (16) and a left manifold (18) connect to the right bank (12) and left bank (14) respectively. Each of the manifolds (16, 18) includes first and second primary runner. For the right bank (12), the first primary runner (22) connects to one cylinder and the second primary runner (24) connects to the other three cylinders. The separate primary runners (22, 24) are configured such that no two cylinders within a given primary runner will begin to exhaust within 180 of each other. The left bank is similarly configured. In this way, interference of exhaust pulses between cylinders is avoided, leading to equal cylinder to cylinder operation with less back pressure, while still using minimal space around the engine.

20 Claims, 2 Drawing Sheets

FIG.3
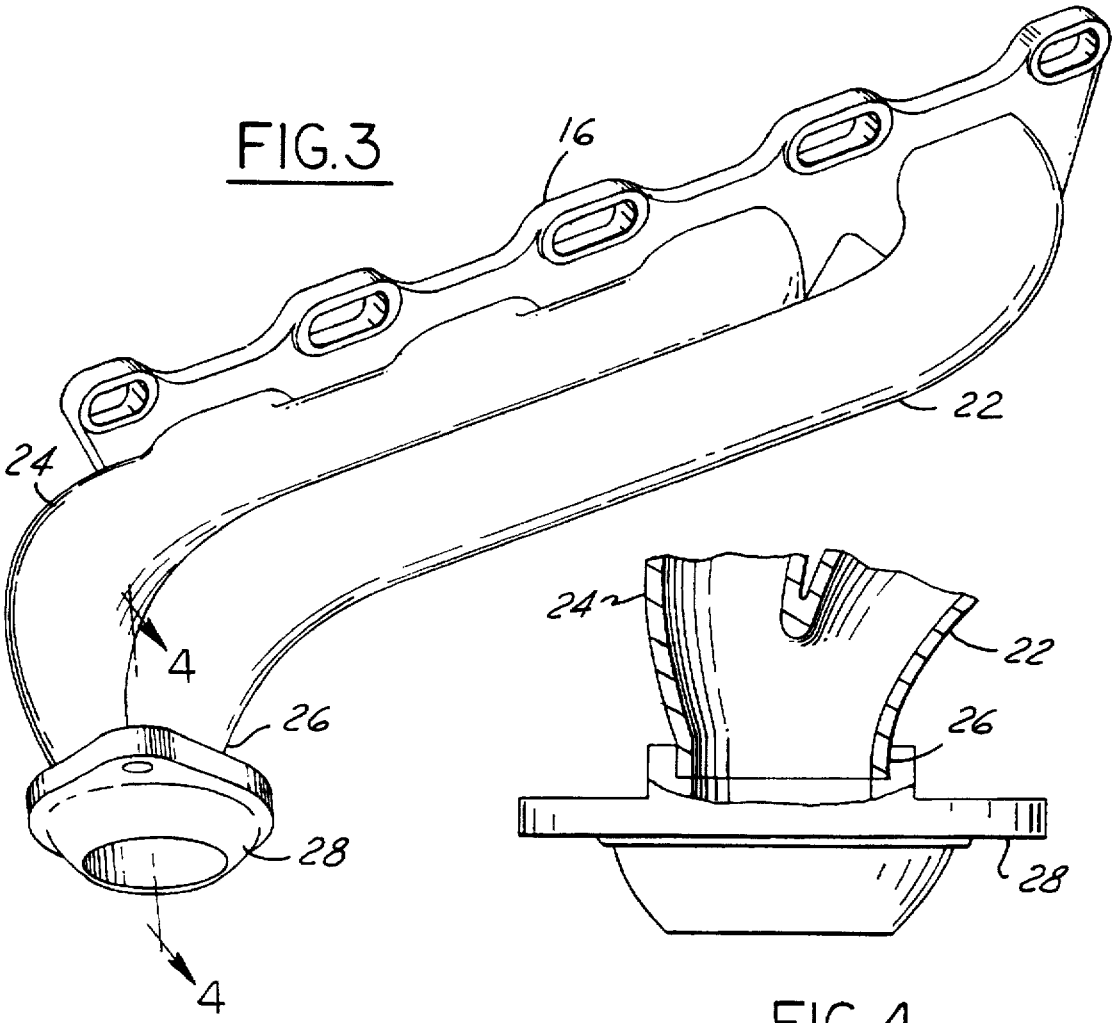
FIG.4
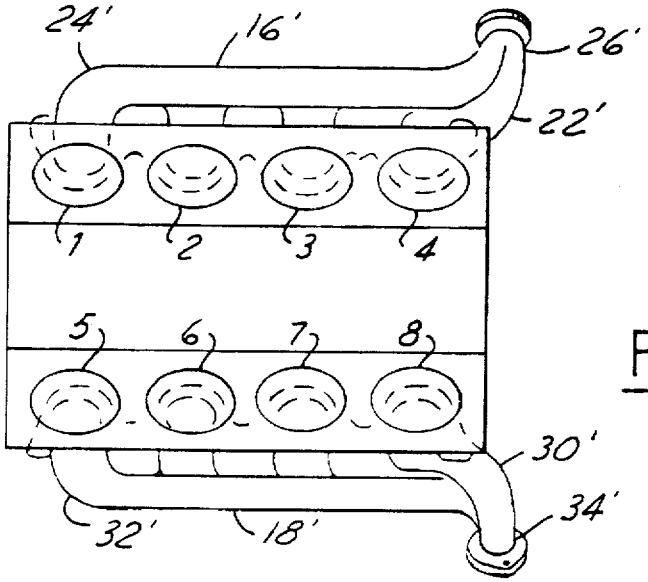
FIG.5

BIFURCATED EXHAUST MANIFOLD FOR A V-TYPE ENGINE

FIELD OF THE INVENTION

The present invention relates to exhaust manifolds used with internal combustion engines in vehicles and more particularly to exhaust manifolds used in V-type engines with at least eight cylinders.

BACKGROUND OF THE INVENTION

Exhaust manifolds associated with internal combustion engines receive the exhaust gas from cylinder exhaust ports and direct it to exhaust pipes or a catalytic converter. This is not a constant flow process because, for four stroke engines, each cylinder only has one exhaust event for every two rotations of the engine crankshaft, with the exhaust event for each cylinder timed differently relative to the crankshaft position than all of the other cylinders. Consequently, the exhaust manifolds actually direct individual pressure pulses of gas through to the exhaust pipe.

The more efficient the exhaust manifold is at passing the pulses of gas, the less back pressure (resulting in pumping losses) and differences in burn rates that will build up in the exhaust system, improving the overall engine efficiency. This is particularly true if the firing order of the cylinders in the engine is such that the timing of gas pulses from cylinders near one another overlap, causing both to try pushing a pulse of gas down the same section of the manifold at the same time.

The problem is particularly acute in V-8 engines, as opposed to other common configurations, such as V-6, I-6 or I-4 engines. The reason being that the four cylinder engines have their exhaust events 180 crankshaft degrees apart, avoiding overlap problems with the gas pulses, since the exhaust event last for about 180 crankshaft degrees. For six cylinder engines, the exhaust events are 120 degrees, allowing for some overlap of the approximately 180 degree exhaust events. However, six cylinder engines are more inherently balanced than V-8 engines, giving a broad choice of firing orders to minimize gas pulse interference problems.

For V-8 engines, the exhaust events are only 90 degrees apart. With two separate banks of four cylinders each, it is physically possible to have a firing order with 180 degrees between each firing. However, these orders create a great amount of mechanical imbalance. Engines in race cars are configured to have the best firing order for engine efficiency and do not care about the smoothness of the engine, but people riding in passenger cars insist on operation without engine vibration problems.

The reason for the imbalance is that a V-8 engine is not a geometrically, inherently balanced design, thus limiting the firing order if one wishes to minimize engine imbalance during operation without having to add a balance shaft. With firing orders used to create good mechanical balance, it is noted that on both banks of cylinders, there are two cylinders near one another coming to an exhaust event only 90 degrees apart. This inherently creates overlapping pressure pulses in both of the exhaust manifolds, thus causing increased back pressure and uneven cylinder to cylinder operation.

Some current V-8 exhaust manifold configurations just accept the overlap of gas pulses, sending all of the gas through a single runner on each bank, and accept the lesser engine performance. While not the most efficient way to control the flow, the cost is generally low and the space taken up around the engine (i.e., packaging) is fairly small. However, this can be particularly inefficient, reducing the overall engine performance significantly.

Other current exhaust manifold configurations provide a separate runner for every cylinder, and join them together behind the engine in order to avoid the interfering gas pulses. While this allows for improved engine efficiency, the packaging requirements are great and the cost is high. One such configuration of this, commonly referred to as a 4-2-1 bifurcated exhaust manifold, provides a separate short runner for each cylinder on a given bank, with two pair of these runners combining into one pair, and finally combining again into a single runner for each bank. This configuration creates cost and packaging concerns.

Therefore, it is desired to allow for four stroke V-8 engines that have firing orders that minimize inherent unbalance concerns during operation and that include exhaust manifolds which avoid problems with overlap of exhaust gas pulses, thereby improving overall engine performance, and yet are cost and space efficient.

SUMMARY OF THE INVENTION

In its embodiments, the present invention contemplates a four stroke internal combustion engine, with the engine having an end referred to as the front end. The engine includes eight cylinders, forming a right bank and a left bank of four cylinders each. The engine also includes a right manifold having a first right primary runner operatively engaging one of the four cylinders in the right bank, and a second right primary runner operatively engaging the other three cylinders in the right bank; and a left manifold having a first left primary runner operatively engaging one of the four cylinders in the left bank, and a second left primary runner operatively engaging the other three cylinders in the left bank.

Accordingly, an object of the present invention is to provide space efficient exhaust manifolds for use with a V-8, internal combustion engine that will allow for balanced engine operation, while avoiding interference of exhaust gas pulses from adjacent cylinders during engine operation.

An advantage of the present invention is that the back pressure (and thus pumping losses) is reduced in the intake manifolds, allowing for improved overall engine performance.

A further advantage of the present invention is that it promotes cylinder to cylinder uniformity of charge, thus equal exhaust residuals remain in the cylinders, making emissions, work and octane tolerances uniform for each cylinder. This allows for easier engine calibration, and improved idle quality and overall octane tolerance for increased low speed wide-open-throttle torque.

BRIEF DESCRIPTION OF THE DRAWINGS

FIG. 3 is a perspective view of an exhaust manifold employed on the right hand bank of cylinders in FIG. 1;

FIG. 4 is a sectional view taken along line 4—4 in FIG. 3; and

FIG. 5 is a view similar to FIG. 1, but illustrating a second embodiment of the present invention.

DETAILED DESCRIPTION OF THE PREFERRED EMBODIMENTS

Figure 1:
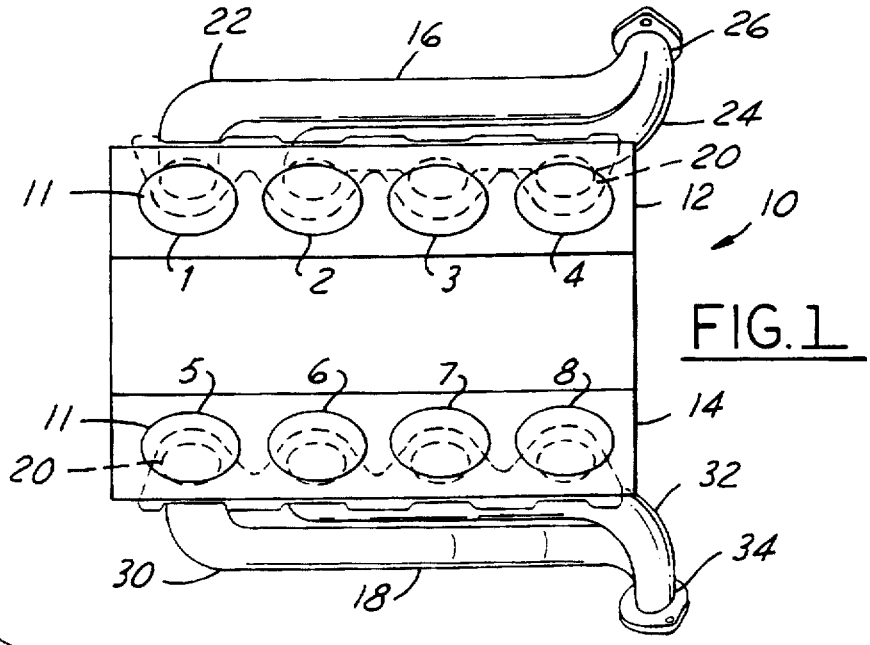
FIG. 1 is a top plan schematic view of a V-8 engine in accordance with a first embodiment of the present invention.

FIGS. 1–4 illustrate a first embodiment of the present invention. An internal combustion engine 10 is configured as a four stroke, ninety degree bank angle V-8, with eight cylinders 11 arranged in a first bank 12 and a second bank 14. While a ninety degree bank is illustrated, the present invention is also applicable to sixty degree bank angle engines as well. The front of the engine 10 is to the left as seen in FIG. 1, with the first bank 12 being referred to as the right hand side. The conventional numbering of cylinders begins with the front right cylinder, identified as element 1, and continues back along that bank (2, 3 and 4). The second bank 14 (left bank) of cylinders includes cylinders 5–8, from front to back, as identified by the corresponding element numbers.

Figure 2:
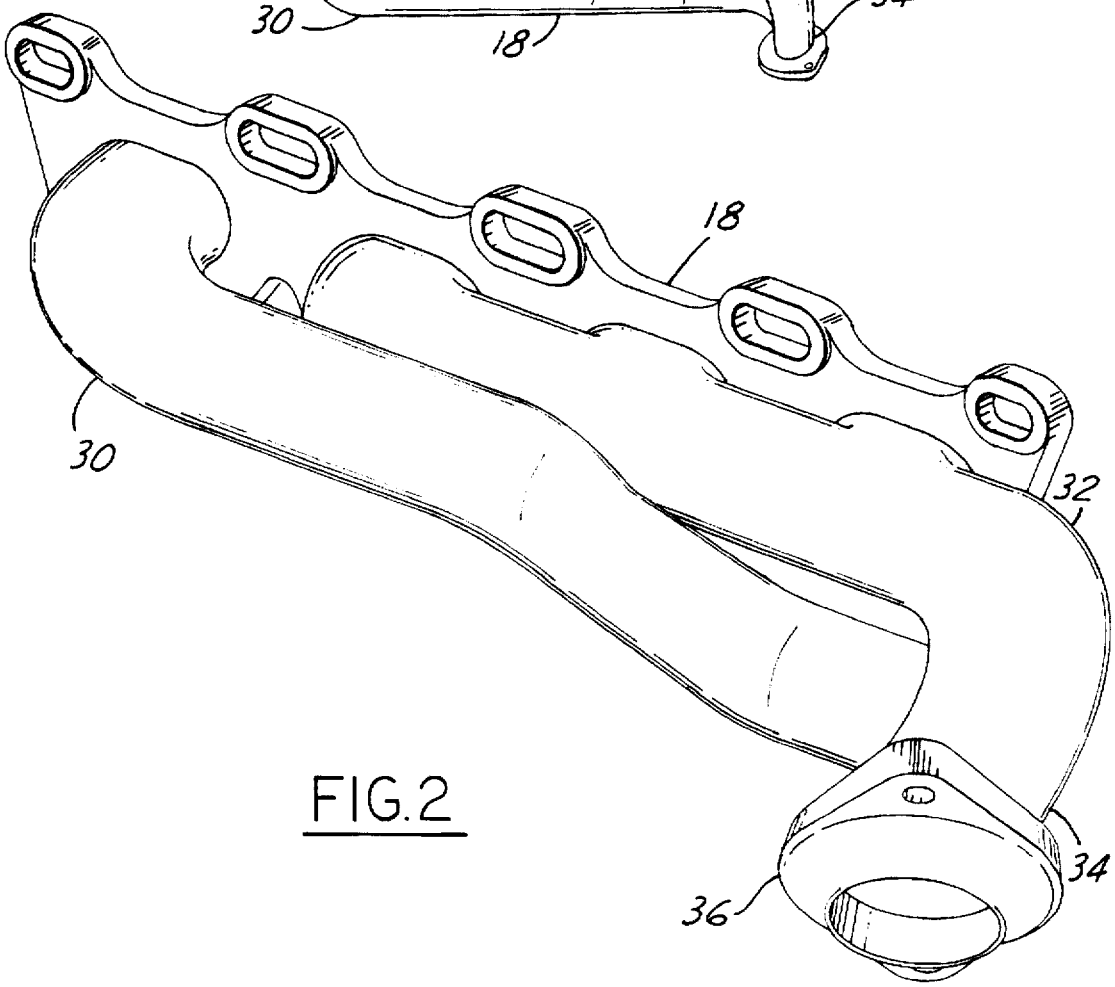
FIG. 2 is a perspective view of an exhaust manifold employed on the left hand bank of cylinders in FIG. 1.

As with typical V-8 engines, there are two exhaust manifolds, a right manifold 16, illustrated in FIG. 3, and a left manifold 18, as illustrated in FIG. 2. Each of the manifolds 16, 18 includes four openings 20, connected to typical exhaust ports from the cylinders 11, for receiving the exhaust gas during engine operation. These two manifolds 16, 18 for this first embodiment are configured for an engine with a cylinder firing order of 1-3-7-2-6-5-4-8. This firing order provides for good mechanical balance of the crankshaft during engine operation.

On the first bank 12, there are two primary exhaust runners, a first right runner 22 and a second right runner 24. The opening 20 in the first right runner 22 connects to cylinder number 1 only, while the second right runner 24 includes three of the openings 20, for cylinders 2, 3 and 4. The two right side runners 22, 24 extend aft of cylinder number 4 and join together to form a single secondary runner 26 at a flange 28. The flange 28, then, connects to a conventional exhaust pipe (not shown) in a conventional manner.

Similarly, on the second bank 14, there are also two primary exhaust runners, a first left runner 30 and a second left runner 32. The opening 20 in the first left runner 30 connects to the opening 20 for the cylinder number 5 only, while the second left runner 32 includes three of the openings 20, for cylinders 6, 7 and 8. The two left side primary runners 30, 32 extend aft of cylinder number 8 and join together to form a single left secondary runner 34 at a flange 36.

This configuration allows for improved performance during engine operation. When the engine 10 is operating based upon the above noted firing order, two adjacent cylinders on the left bank, cylinders 6 and 5 begin exhaust events only ninety crank angle degrees apart. Since the flow of gas from a cylinder during an exhaust stroke is typically about 180 crank degrees, cylinder 5 will be exhausting during the last ninety degrees of the exhaust stroke in cylinder number 6.

Nevertheless, the two exhaust pulses will be segregated from one another until they interact when the two primary runners 30, 32 join together, which is substantially downstream from the exhaust ports. In this way, the two overlapping pulses will not interfere with one another to create undue or uneven back pressure, allowing for equal cylinder to cylinder exhaust flow. This minimizes cylinder to cylinder differences in residual gasses and therefore, differing burn rates and octane tolerances.

Similarly, on the right bank 12, though not immediately adjacent to each other, two cylinders will have ninety crank degree overlapping exhaust strokes, namely cylinders 1 and 3. Although the interference is not as great as on the left bank, since the two are not adjacent, nonetheless, there can still be some interference, leading to unequal cylinder to cylinder operation. Again, the concern is eliminated because cylinders 1 and 3 exhaust into different primary runners 22 and 24, respectively, joining exhaust streams substantially down stream of the exhaust ports.

Thus, for the present invention, there are no two cylinders connecting to the same primary runner that begin their exhaust strokes closer than 180 degrees, eliminating overlap of the pulses. Cylinder to cylinder interference is minimized by this spatial segregation of the point at which the exhaust gasses from two overlapping cylinders first interact. And in fact, this is done with a minimum of primary runners, thus minimizing cost and the packaging space needed around the engine.

FIG. 5 illustrates a second embodiment of the present invention. This embodiment is similar in concept to the first, but segregates a different cylinder on each side due to a changed mechanical design which accommodates a different firing order for the V-8 engine. For this embodiment, like elements will be numbered the same as the first embodiment, with changed elements being given an added prime.

In this embodiment the right and left exhaust manifolds 16', 18' are designed to accommodate a different firing order of a ninety degree bank angle V-8 engine that will also provide good mechanical balance. This firing order is 1-5-4-2-6-3-7-8. For this firing order, the exhaust pulse from cylinder 8 interferes with flow from cylinder 7 half way through the cylinder 7 cycle. Again, this can cause interference problems if connected to same primary runner, since they only fire ninety crank degrees apart, while the exhaust stroke lasts for about 180 crank degrees. Also, cylinder 2 would interfere with the flow somewhat from cylinder 4 (even though not adjacent, as discussed above) if connected to the same primary runner.

For this embodiment then, the right manifold 16' includes a first right primary runner 22' which receives exhaust from cylinder 4 and a second right primary runner 24' which receives exhaust from cylinders 1, 2 and 3. In this way, the exhaust flow from cylinders 2 and 4 is segregated until it reaches the right secondary runner 26', allowing the two to exhaust with minimal interference from each other.

The left manifold 18' includes a first left primary runner 30', which receives exhaust from cylinder 8 and a second left primary runner 32', which receives exhaust from cylinders 5, 6 and 7. This, then, will isolate the exhaust flow from cylinder 7 from the exhaust flow from cylinder 8 until the flows reach the left secondary runner 34'. Again, as in the first embodiment, there will be no two cylinders within any primary exhaust runner that begin their exhaust strokes within 180 degrees of one another.

While certain embodiments of the present invention have been described in detail, those familiar with the art to which this invention relates will recognize various alternative designs and embodiments for practicing the invention as defined by the following claims.

We claim:

1. A four stroke internal combustion engine, having a front end, comprising:

eight cylinders, forming a right bank and a left bank of four cylinders each;

a right manifold including a first right primary runner operatively engaging one of the four cylinders in the right bank, and a second right primary runner operatively engaging the other three cylinders in the right bank; and a left manifold including a first left primary runner operatively engaging one of the four cylinders in the left bank, and a second left primary runner operatively engaging the other three cylinders in the left bank.

2. The engine of claim 1 wherein the right manifold further includes a right secondary runner connecting the first and second right primary runners, and the left manifold further includes a left secondary runner connecting the first and second left primary runners.

3. The engine of claim 1 wherein the first right primary runner operatively engages the cylinder on the right bank nearest the front end.

4. The engine of claim 3 wherein the first left primary runner operatively engages the cylinder on the left bank nearest the front end.

5. The engine of claim 1 wherein the first left primary runner operatively engages the cylinder on the left bank nearest the front end.

6. The engine of claim 1 wherein the first right primary runner operatively engages the cylinder on the right bank farthest from the front end.

7. The engine of claim 6 wherein the first left primary runner operatively engages the cylinder on the left bank farthest from the front end.

8. The engine of claim 1 wherein the first left primary runner operatively engages the cylinder on the left bank farthest from the front end.

9. The engine of claim 1 wherein the four cylinders in the right bank are referred to in order as cylinders 1–4 with the cylinder 1 being closest to the front end, and the four cylinders in the left bank are referred to in order as cylinders 5–8 with the cylinder 5 being closest to the front end, and with the firing order of cylinders of the engine being 1-3-7-2-6-5-4-8.

10. The engine of claim 9 wherein the first right primary runner operatively engages the cylinder number 1 on the right bank and the first left primary runner operatively engages the cylinder number 5 on the left bank.

11. The engine of claim 1 wherein the four cylinders in the right bank are referred to in order as cylinders 1–4, with the cylinder 1 being closest to the front end, and the four cylinders in the left bank are referred to in order as cylinders 5–8, with the cylinder 5 being closest to the front end, and with the firing order of cylinders of the engine being 1-5-4-2-6-3-7-8.

12. The engine of claim 11 wherein the first right primary runner operatively engages the cylinder number 4 on the right bank and the first left primary runner operatively engages the cylinder number 8 on the left bank.

13. The engine of claim 1 wherein the two banks of cylinders are oriented such that they form a ninety degree bank angle between them.

14. A pair of exhaust manifolds for use with two banks of a four stroke, V-8 configured internal combustion engine, having a front end and four cylinders in each bank, the exhaust manifolds comprising:

a right manifold including a first right primary runner adapted to operatively engage one of the four cylinders in the right bank, a second right primary runner adapted to operatively engage the other three cylinders in the right bank, and a right secondary runner connecting the first and second right primary runners; and a left manifold including a first left primary runner adapted to operatively engage one of the four cylinders in the left bank, a second left primary runner adapted to operatively engage the other three cylinders in the left bank, and a left secondary runner connecting the first and second left primary runners.

15. The exhaust manifolds of claim 14 wherein the first right primary runner is adapted to operatively engage the cylinder on the right bank nearest the front end, and the first left primary runner is adapted to operatively engage the cylinder on the left bank nearest the front end.

16. The exhaust manifolds of claim 14 wherein the first right primary runner is adapted to operatively engage the cylinder on the right bank farthest from the front end, and the first left primary runner is adapted to operatively engage the cylinder on the left bank farthest from the front end.

17. A four stroke internal combustion engine, having a front end, comprising:

eight cylinders forming a right bank and a left bank of four cylinders each, with the cylinders in the right bank referred to in order as cylinders 1–4 with the cylinder 1 being closest to the front end, and the four cylinders in the left bank are referred to in order as cylinders 5–8 with the cylinder 5 being closest to the front end;

a right manifold including a first right primary runner operatively engaging one of the four cylinders in the right bank, and a second right primary runner operatively engaging the other three cylinders in the right bank; and a left manifold including a first left primary runner operatively engaging one of the four cylinders in the left bank, and a second left primary runner operatively engaging the other three cylinders in the left bank.

18. The engine of claim 17 wherein the firing order of cylinders of the engine is 1-3-7-2-6-5-4-8, and the first right primary runner operatively engages the cylinder number 1 on the right bank and the first left primary runner operatively engages the cylinder number 5 on the left bank.

19. The engine of claim 17 wherein the firing order of cylinders of the engine is 1-5-4-2-6-3-7-8, and the first right primary runner operatively engages the cylinder number 4 on the right bank and the first left primary runner operatively engages the cylinder number 8 on the left bank.

20. The engine of claim 17 wherein the two banks of cylinders are oriented such that they form a ninety degree bank angle between them.

* * * * *